United States Patent [19]

Wheeler et al.

[11] 3,936,836

[45] Feb. 3, 1976

[54] Z SLOT ANTENNA

[75] Inventors: Myron S. Wheeler, Baltimore; Hall R. McComas, Laurel, both of Md.

[73] Assignee: Westinghouse Electric Corporation, Pittsburgh, Pa.

[22] Filed: July 25, 1974

[21] Appl. No.: 491,916

[52] U.S. Cl. ..... 343/771

[51] Int. Cl.[2] ..... H01Q 13/12

[58] Field of Search ..... 343/767, 768, 769, 770, 343/771

[56] References Cited

UNITED STATES PATENTS

| | | | |
|---|---|---|---|
| 2,633,532 | 3/1953 | Sichark | 343/771 |
| 2,756,421 | 7/1956 | Harvey et al. | 343/770 |
| 3,364,489 | 1/1968 | Masters | 343/768 |
| 3,638,224 | 1/1972 | Bailey et al. | 343/771 |
| 3,696,433 | 10/1972 | Killion et al. | 343/771 |
| 3,810,186 | 5/1974 | Nakahara et al. | 343/771 |

*Primary Examiner*—Eli Lieberman
*Attorney, Agent, or Firm*—D. Schron

[57] ABSTRACT

An improved antenna of a coaxial type utilizing Z-shaped slots disposed in the outer conductor to provide an omnidirectional antenna pattern. Current coupling to the slots is achieved by means of the transverse portion of the Z slot. Detuning effects due to the presence of a transmission line are compensated for by dielectrically loading the slots with a dielectric cover over the coaxial line and/or by lengthening the longitudinal arms of the Z. The longitudinal spacing between each slot and the length of the transverse portion of each slot are chosen while considering all line effects to obtain the required phase and amplitude relationships. The antenna consequently requires no additional coupling, tuning or phasing devices mounted within or without the coaxial line.

5 Claims, 5 Drawing Figures

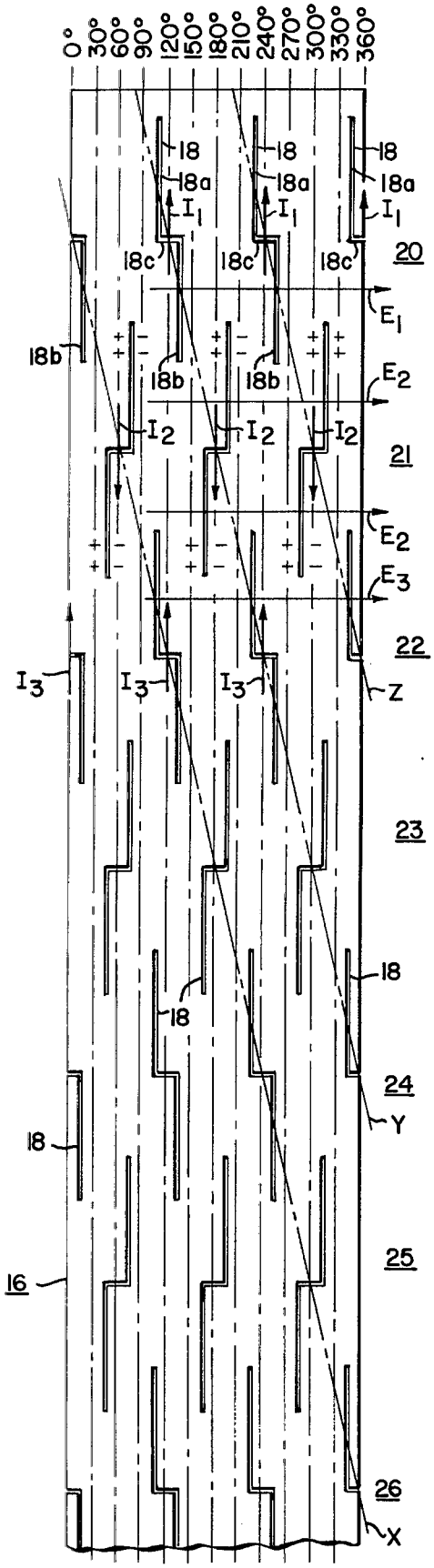
FIG.4
FIG.3
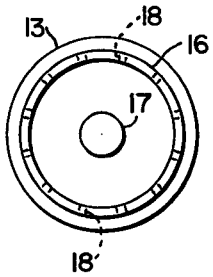
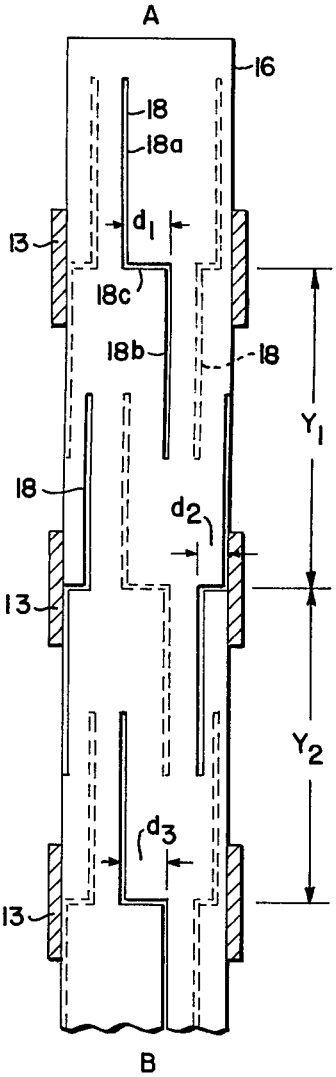
FIG.2

Z SLOT ANTENNA

BACKGROUND OF THE INVENTION

1. Field of the Invention

This invention pertains to an antenna for radiating an omnidirectional antenna pattern. More specifically, it is directed to a coaxial type antenna having improved coupling, tuning and phasing characteristics.

Prior art techniques used to achieve onmidirectional coverage of a horizontally polarized signal have been somewhat complicated in implementation. Yet the need for a simpler antenna system to provide this type of pattern is present in applications such as television broadcasting.

To produce the required elevation pattern, the antenna designer calculates the phase and amplitude required in the numerous radiating elements along the vertical radiator. The radiating elements are then spaced at nominal ½ λ or 1 λ (where λ is the wavelength) and each is matched to the line and so phased relative to adjacent radiating elements to give the required vertical pattern. The elements may be spaced around the vertical mast of the antenna to give an omnidirectional radiation in azimuth as may be required by the diameter to wavelength ratio of the coax, the larger diameter requiring more elements to obtain a required azimuth uniformity.

A common prior art antenna system which is easily adapted by the above described technique to give the desired pattern, utilizes a coaxial line as the vertical mast and vertical narrow slots in the outer conductor of the coaxial line as the individual radiator elements. Several methods have been used to couple the vertical slots to the transmission line. One is to couple the slots by means of inductive conducting loops behind the slots and oriented to align with the circumferential magnetic field within the coaxial line. A second coventional method of coupling the radiating slots to the transmission line is to simply connect one side of the slot to the center conductor of the coaxial line.

Both of the above coupling techniques provide a usable antenna covering one television channel in bandwidth.

Nonetheless the prior art antenna systems which have been used to achieve onmidirectional coverage with a horizontally polarized signal have required empirical adjustment by the antenna designer to achieve the desired antenna pattern, have been limited in frequency handling capability and the slot Q is often too high making it practically impossible to cover a 6 percent band as is usually required for carrying two television channels simultaneously near 800 MHz.

SUMMARY OF THE INVENTION

The present invention comprises a coaxial type antenna system using a plurality of Z shaped slots disposed on the outer conductor in the antenna. In the described embodiment the slots are spaced circumferentially around the coaxial antenna to give 360° coverage and are arranged in bays spaced along the longitudinal axis of the antenna. Each slot has a small portion transverse to the main portion of the slot and optimally at the center plane of the slot whereby the slots are descriptively identified as Z shaped. The small transverse portion lying in a circumferential direction with regard to the outer conductor couples resistively the radiating slot to the transmission line. The spacing between each slot and the width of the transverse portion of each slot are so chosen, considering all line effects, that the required phasing and amplitude control are obtained without additional tuning and phasing devices.

BRIEF DESCRIPTION OF THE DRAWINGS

The invention will now be described with reference to the accompanying drawings, in which:

FIG. 2 is a partial vertical elevation view of a slotted coaxial waveguide antenna in accordance with the present invention;

FIG. 3 is an end view of the embodiment shown in FIG. 2;

FIG. 4 is a developed view of the circular cylindrical outer conductor of the antenna showing the relative positions of the slots.

DETAILED DESCRIPTION OF THE PREFERRED EMBODIMENT

Figure 1:
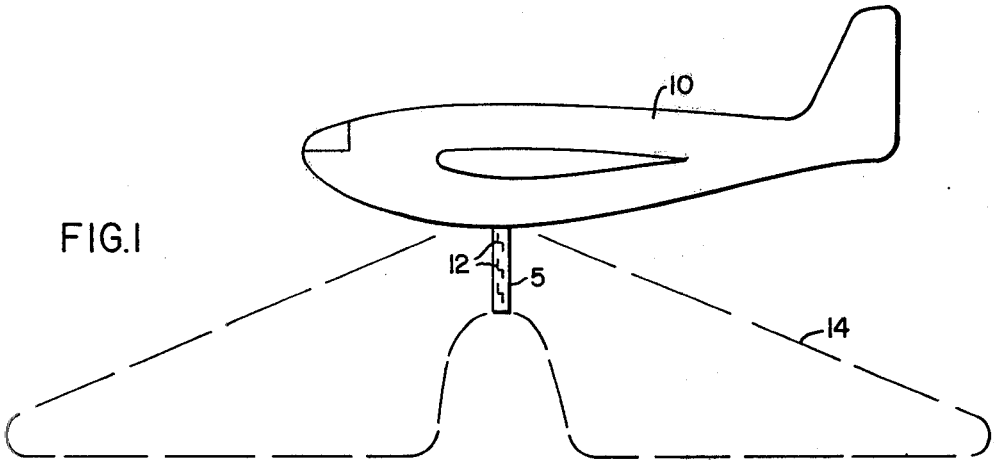
FIG. 1 is a schematic representation of one embodiment adapted for an airborne environment and showing the general shape of the horizontal radiation pattern.

Referring to the drawings, in particular, FIG. 1 an antenna assembly 5 is shown suspended from the bottom of the fuselage of an aircraft 10 in an airborne adaptation of the present invention. Radiating slots 12 are disposed on the outer conductor of antenna assembly 5 aligned with the longitudinal axis of the assembly 5. It is to be understood that a transmitter not shown is carried by the aircraft and supplies a modulated carrier to the coaxial line antenna 5. Although not constituting a part of this invention, the antenna assembly 5 to operate properly, would be suitably supported by means of a gyrostabilized coupling mechanism (not shown) so that the antenna could be maintained in a vertical position relative to the ground surface independent of the attitude of the aircraft 10.

The antenna pattern 14 provides omnidirectional coverage with a horizontally polarized signal. Such coverage for instance, is appropriate for television broadcasting to receivers located within the operating range of such a mobile transmitter and antenna.

In FIGS. 2 and 3, the present invention is shown in greater detail. An outer conductor 16 is aligned coaxially with an inner conductor 17 forming a coaxial line vertical mast type of antenna. The coaxial diameter will usually not be greater than half a wavelength to avoid unwanted higher modes. The power requirements determine the minimum size. The outer conductor 16 is provided with a plurality of Z shaped slots 18 which constitute radiating elements. The slots have portions 18*a* and 18*b* extending longitudinally of the antenna assembly 5 connected by a transverse coupling portion 18*c*. The portions 18*a* extend from the respective transverse portions 18*c* toward the feed end of an antenna assembly 5 designated by A. The outer longitudinal portions 18*b* extend toward the opposite end of antenna assembly 5 designated by B.

The Z shaped slots whose transverse portions 18*c* lie in a single transverse plane constitute one bay. Each bay in the embodiment of FIG. 2 has three radiating slots spaced circumferentially around the outer conductor 16 at intervals of 120°. The number of slots in a bay can be changed depending on the pattern requirements.

Each of the elongated longitudinal portions 18*a* and 18*b* is substantially ¼ of the operating wavelength long. The radiating portions of one bay may overlap the radiating elements of an adjacent bay for about 1/6 of their length in the longitudinal direction. The spacing of the transverse coupling portion 18*c* of corresponding radiating elements 18 in adjacent bays varies in a manner and for reasons described in detail hereinafter. Because of the slight overlap in the longitudinal direction between adjacent bays, the spacing between the centers of the radiating elements 18*c* of adjacent bays is somewhat less than ½ wavelength. Still the overall length of a given radiating element 18 is substantially ½ of the operating electrical wavelength long. The total length of the slot 18 is made half wave resonant at the frequency used but the length will be greater as the number of slots per bay is increased to compensate for the diminishing volume available behind each slot 18.

The individual bays consisting of three radiating elements spaced circumferentially 120° apart, provide an omnidirectional pattern. Increasing the number of slots per bay reduces the power in each slot, reduces the azimuth power variation in the field pattern but weakens the antenna structurally. To shape the radiation pattern and increase the gain in the vertical plane, a plurality of bays is stacked vertically, that is, in a direction longitudinal to the coaxial antenna assembly 5 at distances $Y_1$, $Y_2$ etc. To achieve the desired pattern, it is necessary to position the elements of the bays in a manner to get the proper phase and amplitude as hereinafter explained.

To adjust the electrical length of the slots 18 for proper tuning to eliminate deleterious effects of the transmission line, it is sometimes necessary to dielectrically load the slots with suitable dielectric bands 13 mounted against the outside conductor 16 as shown in FIG. 2. Other well known means may be provided for accomplishing the same result; however, the use of dielectric bands 13 does provide a simple, inexpensive arrangement lending itself to a straight forward engineering design.

Referring now to FIG. 4, a developed view of the circular cylindrical outer conductor 16 shows clearly the positioning of the Z-shaped slots in each bay and the relationship between adjacent bays. Across the top the outer conductor 5 has been divided into 30° segments ranging from 0° to 360°. A series of vertically stacked bays of radiating elements 20 through 26 are shown. It is shown in FIG. 4 that corresponding radiating elements 18 of adjacent bays such as bays 20 and 21 are circumferentially 60° apart; that is elements 18 of adjacent bays are uniformly and alternately distributed around the outer conductor at 60° intervals. The affect is that the bays 20 through 26 are progressively advanced so that the central coupling portion 18*c* of the radiating elements 18 of adjacent bays are centered on spiral lines X, Y, Z.

The radiating elements 18 although being of the order of ½ of the operating wavelength are spaced apart longitudinally from one bay to the next by a distance Y which may be slightly different than ½ wavelength, measured along the axis of the coaxial line from one center portion 18*c* to the next. That is to say if no synthesis of the pattern is necessary and all slots radiate in phase the spacing would be ½ λ. However, if the beam requires tilting or shaping the phase from bay to bay may differ and the spacing is accordingly different than ½ λ. The significant point about the vertical spacing is that the central transverse coupling portions 18*c* of the radiating elements 18 are coupled to the current in the coaxial line so as to provide the required phase of excitation. The phase of the current vectors at the central horizontal planes through the respective bays is indicated by the direction of the current vectors $I_1$, $I_2$, and $I_3$. In order to represent the phase relations of the radiating elements 18 of each bay, plus and minus signs have been arbitrarily placed on the left and right sides of the radiating slots 18. Thus, the wave energy radiating from all of the slots in any one bay 20 through 26, is exactly in phase which is a necessary condition for the omnidirectional pattern in the horizontal plane.

The radiating Z-shaped slots 18 are approximately in phase from bay to bay as required for the broad side elevation pattern as shown in FIG. 1. Assume that the positions of the Z-shaped slots 18 in the first bay 20 are such that the polarity of the line current is as indicated when the current vectors $I_1$ are oriented as shown in FIG. 4. It is apparent that at a point in the coaxial line antenna assembly 5, substantially ½ wavelength away from the plane of the central coupling portion of the first bay 20, the current vectors $I_2$ will be in the opposite direction at the center plane of the second bay 21 if the Z-shaped slots are similarly oriented from bay to bay. Accordingly, to maintain the same phase of the radiating energy from adjacent bays, the Z-shaped slots 18 of alternate bays are arranged so that the longitudinal portions 18*a* and 18*b* are reversed with respect to portion 18*c*. It is then true that the horizontal component of the electric field represented by both the minus and plus signs and vectors $E_1$, $E_2$, and $E_3$ are all directed to the right as required to produce a desired antenna pattern. Since the reversal of the Z slot radiating element is repeated, between adjacent bays throughout the antenna, the total radiating energy from the coaxial line antenna assembly 5 will be in phase.

It should be understood that the initial phase of the current $I_1$ has been chosen arbitrarily for the purpose of illustration and that the significant aspect of the invention is that for all Z-shaped radiating elements 18, the current vectors must be aligned along the same horizontal direction while the slots 18 are reversed for alternate bays so as to keep the wave energy radiating from the different bays 20 through 26 in phase.

From FIG. 4, it is apparent that radiating elements 18 is alternate bays such as 20, 22, 24 and 26 or 21, 23 and 25, are respectively longitudinally centered along axes parallel to the axis of the coaxial line antenna assembly 5. Thus, the radiating elements of bays 20, 22, 24 and 26 have the same relative position with respect to each other and are centered on vertical lines parallel to the axis of the antenna while the radiating elements of bays 21, 23 and 25 have reversed radiating elements centered on vertical lines also parallel to the longitudinal axis of the coaxial line antenna assembly 5. The radiating elements of the bays 20, 22, 24 and 26 are centered on lines which are intermediate the centering lines of the elements of bays 21, 23 and 25. Thus, there is provided a plurality of broad side arrays placed side by side with all the radiation patterns directed radially and downwardly with energy radiating nominally in phase.

To adjust the vertical plane, of the omnidirectional pattern as shown in FIG. 1 to give the desired coverage, it is well known that the relative phase and amplitude of the voltage at each radiating slot 18 is set to a prescribed value. the relative amplitude of the excitation is achieved by selection of the proper length of the transverse portion 18*c* which is shown as $d_1$, $d_2$, $d_3$... in FIG. 2. The phase is determined by the distance between adjacent bays measured longitudinally from the transverse portion of one slot 18 to the transverse portion of a corresponding slot advanced 60° circumferentially in the next adjacent bay. In FIG. 2, that distance is indicated as $Y_1$, $Y_2$,... To make an adjustment to the vertical plane the lengths d and Y for the bay furtherest from feed point A are adjusted to account for transmission line effects. The adjustment continues from bay to bay in a sequential order to obtain relative phase and amplitude relationships of the voltage at each slot to give the desired pattern coverage.

It will usually be necessary to reverse the Z-shaped slots of alternating bays, as has been explained above, to achieve the correct phase relationship for each element and simulataneously to give approximate half wave electrical spacing of the radiating slots 18 along the coaxial line.

The antenna pattern adjustment process may be carried out by machine calculation to determine the values of *d* and *Y* along the entire length of the antenna assembly 5. This procedure is possible because the radiating slots 18 are non-reactive at resonance and form a simple discontinuity on the transmission line.

It is a characteristic of this antenna that there are few design parameters, the important ones as discussed are the number of slots per bay, the total slot length, the length of the transverse portion of the slot, the bay spacing and the relative rotation of adjacent bays. The design parameters can be changed depending on the design problem, and the embodiment described herein is merely representative of a large family of antennas included in this invention.

Figure 5:
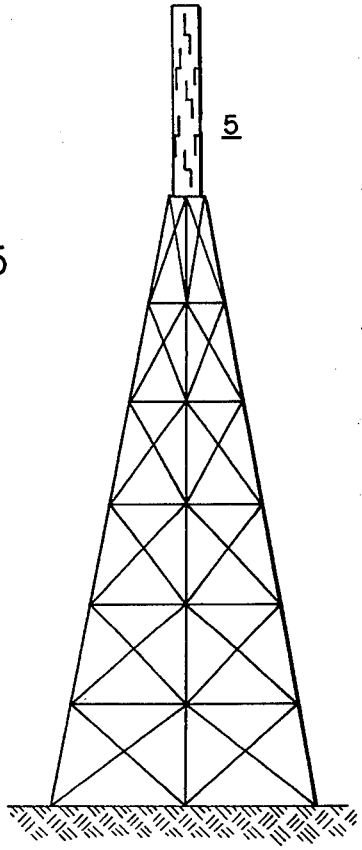
FIG. 5 is a schematic representation of one embodiment adapted for tower installation.

It should be readily apparent that the present invention is not limited to a mobile antenna but can be used also in a stationary installation, such as that shown in FIG. 5. In such an installation a uniform omnidirectional coverage for a localized area is possible for conventional television broadcasting or other omnidirectional transmission. It will be apparent that this invention is not necessarily limited to television broadcasting but could be used for many types of communication installations such as police communication networks and air navigation guidance installations. In airplane landing systems, it could be used for omnidirectional homing beacons.

It will be understood that slotted antennas may also be made within the above concept wherein the radiating slots are spaced at a nominal one wavelength. In such an arrangement the Z slot sections will all face in the same direction to achieve the nominal in-phase radiation. This is as though alternate bays had been omitted from the above discussion.

What is claimed is:

1. An antenna assembly comprising a coaxial transmission line having inner and outer coaxial conductors, said outer conductor having a plurality of radiating slots spaced circumferentially of said line, said slots extending longitudinally of said outer conductor and including respective coupling sections which extend transversely of said line to provide coupling apertures to current on said line, said plurality of slots being arranged in bays, each of said bays being composed of a plurality of slots having respective coupling sections lying in the same plane transverse to the longitudinal axis of said transmission line, adjacent bays of radiating slots being angularly displaced with respect to individual radiating slots of the respective bays for improving the omnidirectional coverage of the pattern of said antenna assembly.

2. An antenna comprising elongated waveguide means having an outer cylindrical conductor, means for producing radio frequency currents in said waveguide means, a plurality of spiral rows of radiating slots in said outer conductor, said rows being spaced circumferentially on said conductor so as to provide an omnidirectional radiation pattern, said slots including longitudinally extending radiating portions and transverse coupling portions, the total electrical length of said slots being substantially equal to one-half electrical wavelength, the coupling portions of said slots of each spiral row being spaced apart longitudinally of said conductor a distance substantially equal to one-half electrical wavelength in said waveguide means.

3. The antenna assembly of claim 2 wherein at least one of said radiating slots is partially loaded by dielectric means in intimate contact with said outer cylindrical conductor.

4. The antenna assembly of claim 2 wherein adjacent slots in the respective spiral rows are partially overlapping longitudinally of said conductor.

5. An antenna comprising elongated coaxial waveguide means having a central conductor and an outer cylindrical conductor, a plurality of radiating elements in the form of slots in said outer conductor, each comprising a central coupling portion extending transversely of said conductor and a pair of portions extending longitudinally in opposite directions from opposite sides of said central transverse portion, said central transverse portions being arranged in circumferentially spaced spiral lines of selected pitch about the axis of said outer conductor, the longitudinally extending portions extending from said central portion toward the feed end of said waveguide means being on one side of the respective spiral lines while the other longitudinal portions extending from their respective transverse portions toward the other end of said waveguide means being on the opposite side of said respective spiral lines, the total length of said radiating elements being substantially one-half electrical wavelength, and the centers of said slots in the respective rows being spaced longitudinally substantially one-half electrical wavelength in said waveguide means.

* * * * *